US005959252A

United States Patent [19]

Ide et al.

[11] Patent Number: 5,959,252

[45] Date of Patent: Sep. 28, 1999

[54] COVERED WIRE CONNECTION STRUCTURE

[75] Inventors: Tetsuro Ide; Nobuyuki Asakura, both of Shizuoka-ken, Japan

[73] Assignee: Yazaki Corporation, Tokyo, Japan

[21] Appl. No.: 08/867,744

[22] Filed: Jun. 3, 1997

[30] Foreign Application Priority Data

Jun. 4, 1996 [JP] Japan ..... 8-141862

[51] Int. Cl.[6] ..... H01R 4/00

[52] U.S. Cl. ..... 174/84 R; 29/872

[58] Field of Search ..... 174/84 R, 94 R, 174/84 C; 29/872, 868

[56] References Cited

U.S. PATENT DOCUMENTS

| | | | |
|---|---|---|---|
| 2,250,156 | 7/1941 | Ferguson | 174/84 R |
| 3,244,798 | 4/1966 | Warner | 174/84 R |
| 4,878,969 | 11/1989 | Janisch | 174/94 R |
| 5,584,122 | 12/1996 | Kato et al. | 174/84 R |

FOREIGN PATENT DOCUMENTS 7-320842 12/1995 Japan .

*Primary Examiner*—Kristine Kincaid
*Assistant Examiner*—William H Mayo, III
*Attorney, Agent, or Firm*—Finnegan, Henderson, Farabow, Garrett & Dunner, L.L.P.

[57] ABSTRACT

Two covered wires conductively connected are overlapped with each other at connection portions S. The overlapped connection portions are pinched by a pair of resin chips. Cover portions are melted and the conductive wire portions of both the covered wires are conductively contacted with each other at the connection portions by pressing from outside of the resin chips. Then, the pair of the resin chips are melt-fixed to each other to seal the connection portions. The resin chips are provided with first melting portions which are melt-fixed to a mating chip in area including the connection area to seal the connection portions and second melting portions which are separated from the first melting portions and melt-fixed to the mating chip in area other than the connection portion. Thus, it is possible to achieve reduction of conducting resistance and improvement of mechanical strength.

6 Claims, 3 Drawing Sheets

COVERED WIRE CONNECTION STRUCTURE

BACKGROUND OF THE INVENTION

This invention relates to a connection method and structure for connecting covered wires with each other or connecting a covered wire to another member.

As a conventional connection structure for this kind of covered wires, an art proposed by this inventor (see Japanese Laid-Open Patent Application No. 7-320842) will be described.

For connecting two covered wires the outer periphery of which is coated with a cover portion made of resin, at their intermediate connection portions, a pair of resin chips which are of resin material, a horn for producing ultrasonic vibration, and an anvil for supporting the covered wires and resin chips at the time of connection are utilized. The anvil includes a base stand and a support portion projecting from the base stand. The support portion is designed in a substantially cylindrical shape. The support portion has a bore portion which is opened at the opposite side to the base stand side. Two pairs of grooves are formed on the peripheral wall of the support portion so as to cross with each other substantially at the center of the bore portion. The four grooves are formed so as to open on the same side as the bore portion, extending along the projection direction of the support portion and intercommunicate with one another through the bore portion.

The pair of resin chips are designed in a disc shape having a slightly smaller outer diameter than the diameter of the bore portion of the anvil. Furthermore, an end face of a head portion of the horn is designed in a disc shape having an outer diameter which is substantially equal to or slightly smaller than that of the resin chips.

In order to connect the two covered wires to each other, both of the covered wires are overlapped with each other at the connection portion thereof and the overlapped connection portions are pinched by the pair of resin chips from the upper and lower sides of the connection portions. Specifically, one of the resin chips (the resin chip at the lower side) is inserted into the bore portion of the anvil such that the melting surface thereof is directed upward. Then, one covered wire is inserted into the pair of confronting grooves from the upper side of the inserted resin chip. Then, the other covered wire is inserted into the other pair of the confronting grooves. Finally, the other (upper side) resin chip is inserted such that the melting surface is directed downward. The covered wires are arranged in the bore portion so that the respective connection portions thereof cross each other at the center of the bore portion. Through this arrangement, the connection portions of the covered wires are pinched substantially at the center of the melting surfaces of the upper and lower resin chips respectively in the overlapping direction.

Subsequently, the cover portions at the connection portions of the covered wires are melted so as to be dispersed by ultrasonic vibration. Furthermore, the conductive wire portions (core) of the covered wires are conductively contacted with each other at the connection portion by pressing the covered wires from the outside of the resin chips. Thereafter, the pair of the resin chips are mutually melt-fixed at the melting surfaces to seal the connection portion.

Specifically, the head portion of the horn is inserted into the bore portion from the upper side of the finally-inserted upper (other) resin chip and placed on the upper resin chip to excite and press the connection portions of the covered wires from the outside of the upper and lower resin chips between the horn and the anvil. The cover portions are first melted and the conductive wire portions of the covered wires are exposed at the connection portion between the resin chips. At this time, the melted cover portions are extruded from the center side of the resin chips toward the outside thereof because the connection portions are pressed from the upper and lower sides, so that the conductive wire portions are more excellently exposed and surely conductively contacted with each other. Like the press direction, the direction of the excitation of the connection portions is set to be coincident with the overlapping direction of the covered wires, so that the action of extruding the melted cover portions from the center side of the resin chips to the outside thereof is promoted.

When the pressing and exciting operation on the connection portions is further continued after the melting of the cover portions, the resin chips are melted and the confronting melting surfaces of the resin chips are melt-fixed to each other. In addition, the outer peripheral surface portions of the cover portions which are adjacent to the conductively contacted conductive wire portions and the resin chips are melt-fixed. With this operation, the outer peripheral portions of the conductively-contacted conductive wire portions are kept to be coated with the resin chips.

However, according to the above described connection structure, the core wires composing the conductive wire portions 1 are loosened in the interior of the resin materials 51 to increase conductive contacting points of the covered wires and the loosened core wires are contacted with each other in the connection portion area. Thus, such area in which the resin chips are directly melt-fixed not via the conductive wire portions (hatched portion in FIG. 7) is limited so that the melt-fixing force of the resin chips is reduced. For the reason, it is difficult to achieve reduction of resistance at the connection portions and increase of the melt-fixing force between the resin chips (improvement of mechanical strength).

SUMMARY OF THE INVENTION

It is therefore an object of the present invention to provide a covered wire connection structure capable of achieving reduction of resistance and improvement of mechanical strength.

In order to achieve the above object, according to the present invention, there is provided a covered wire connection structure of conductively connecting members at least one of which is a covered wire having a conductive wire portion and a cover portion formed by coating resin around an outer periphery of the conductive wire portion, the structure being formed by overlapping the members with each other and pinching an overlapping portion of the members between a pair of resin chips, pressurizing and exciting the overlapping portion pinched by the resin chips using an ultrasonic vibration welding apparatus so as to melt and disperse the cover portion, thereby to expose the conductive wire portion and electrically conductively connect the conductively wire portions of the members at the overlapping portion and so as to melt-fix the pair of resin chips to seal the connected overlapping portion of the members with the melted resin chips, characterized in that each of the resin chips has first melting portion and second melting portion, the first melting portion is located in an area including the overlapping portion and melt-fixed to a mating chip to seal the overlapping portion, and the second melting portion is separated from the first melting portion and melt-fixed to the mating chip in area other than the overlapping portion.

The first melting portion may be provided on a center portion of a surface of the resin chip, and the second melting portion may be provided on an outer edge portion excluding the center portion of the surfaces of the resin chip and passage routes so as to pass the covered wires to the center portion.

The second melting portion may be an outer edge flat portion excluding the first melting portion and the passage routes, one of the first melting portions may be a convex flat portion which is a top surface of a protrusion disposed so as to protrude from the outer edge flat portion of one of the chips, and the other of the first melting portions may be a concave flat portion which is a bottom surface of a hole disposed so as to indent from the outer edge flat portion of the other of the resin chips.

According to the construction described above, both the members are overlapped with each other at the connection portions (overlapping portion) and the overlapped connection portions are pinched by the first melting portions of the pair of the resin chips. Then, the cover portions are melted by ultrasonic excitation so as to be dispersed and pressed from outside of the resin chips. With such a simple method, both the members can be conductively contacted with each other at the connection portions and can be conductively connected to each other by such a simple operation.

Further, the first melting portions which are melt-fixed to a mating chip in area including the connection portions and the second melting portions which are separated from the first melting portions and melt-fixed to the mating chip at area other than the connection portions are contained in respective resin chips. Thus, even if the core wires composing the conductive wire portion which is formed between the first melting portions are sufficiently loosened in order to increase the conductive contacting points of the covered wires and suppress resistance, the second melting portions can be directly melt-fixed to each other not via the conductive wire portion. Thus, a sufficient melting force can be obtained. That is, even if the core wires composing the conductive wire portion between the first melt-fixing portions are sufficiently loosened in order to increase conductive contacting points of the covered wires and suppress resistance, a sufficient melt-fixing force can be obtained because the second melting portions are directly melt-fixed to each other not via. the conductive wire portion, and it is possible to achieve reduction of the resistance and improvement of mechanical strength.

The passage routes for the covered wires may contain wire nipping portions for nipping the cover portions of the covered wires as the resin chips are melt-fixed to each other.

According to the construction described above, during actual use after the resin chips are melt-fixed to each other, the wire nipping portions nip the cover portions of the covered wires in form of a wedge. Thus, an external force applied to the covered wire is not applied directly to the connection portions and instead the wire nipping portions receive that force. Thus, a high wire holding force can be obtained thereby further improving the mechanical strength.

DESCRIPTION OF THE PREFERRED EMBODIMENTS

Hereinafter, an embodiment of the present invention will be described with reference to the accompanying drawings.

Figure 1:
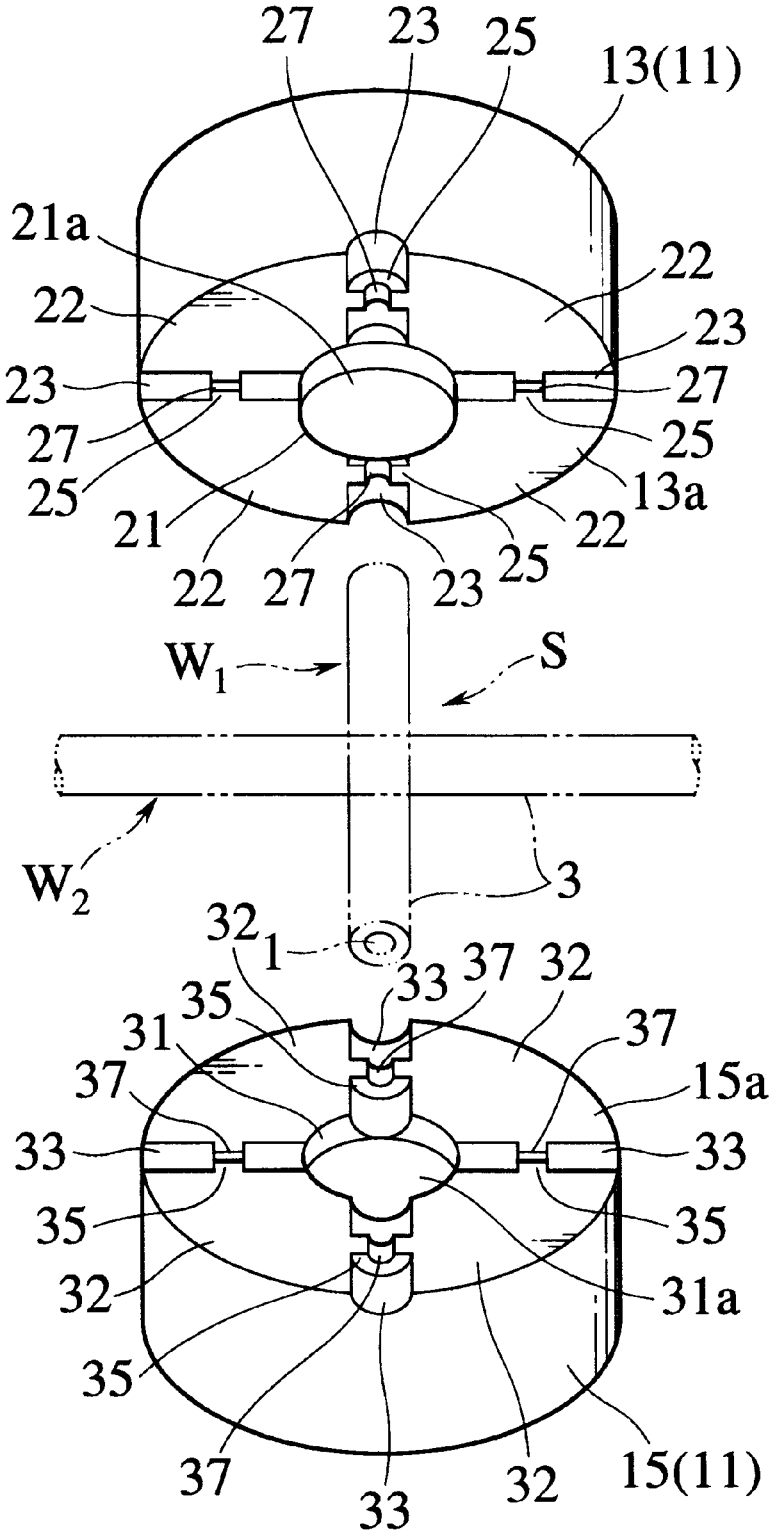
FIG. 1 is a perspective view of a covered wire connection structure according to the instant embodiment showing a state in which upper and lower resin chips are separated.
Figure 2:
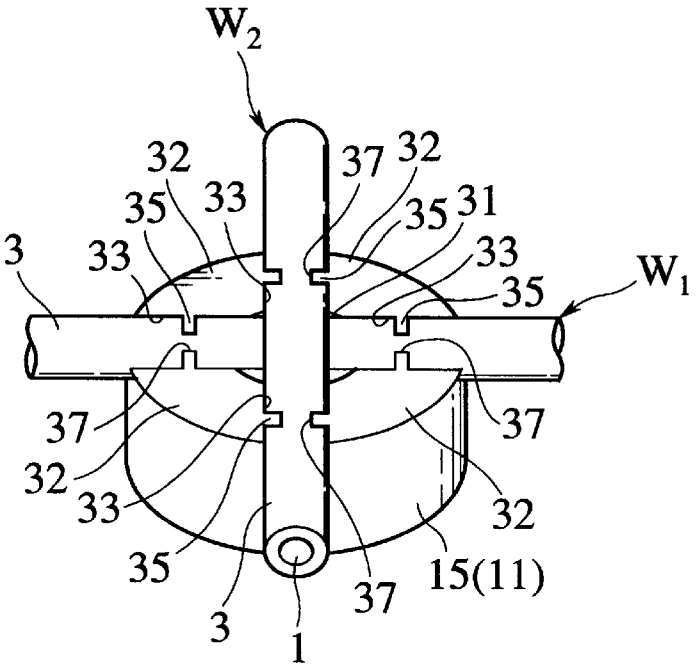
FIG. 2 is a perspective view showing a lower resin chip and covered wires.
Figure 3:
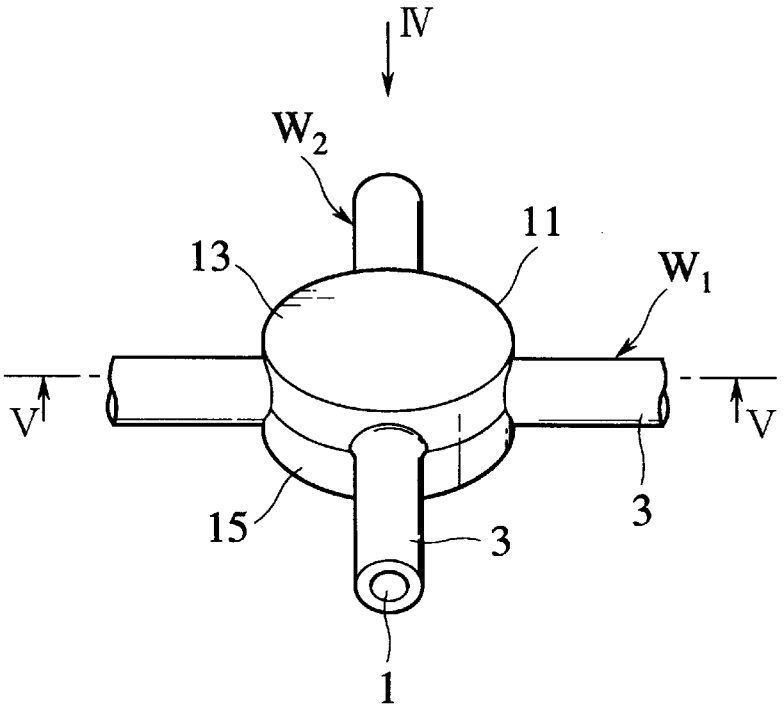
FIG. 3 is a perspective view of appearance showing a state after the resin chips are melt-fixed to each other.
Figure 4:
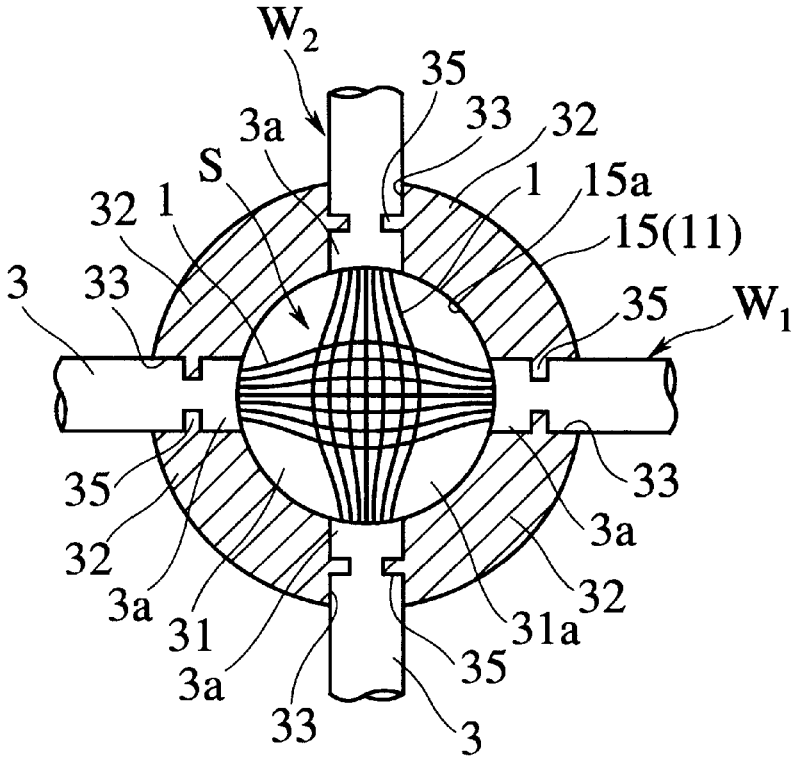
FIG. 4 is a schematic view showing a cross section taken from a direction of IV in FIG. 3.
Figure 5:
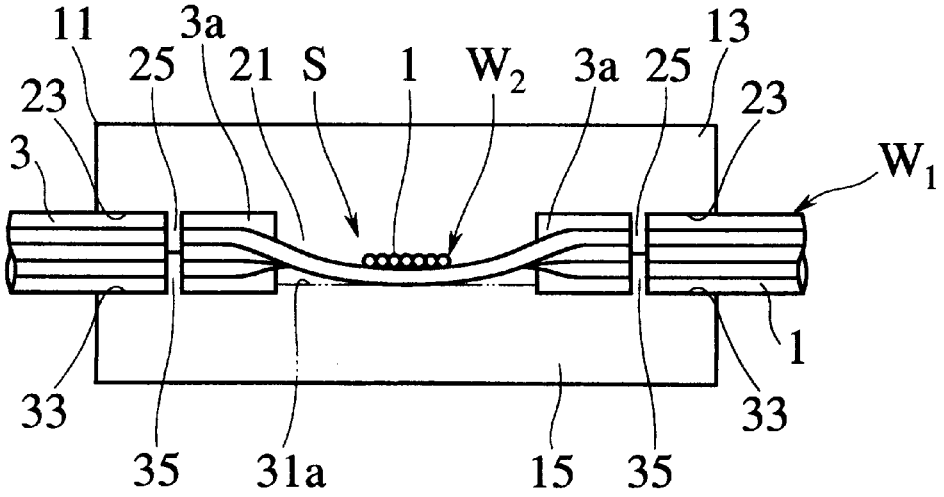
FIG. 5 is a sectional view taken along the lines V—V in FIG. 3.

FIG. 1 is a perspective view showing a covered wire connection structure according to the instant embodiment in a state in which upper and lower resin chips are separated. FIG. 2 is a perspective view showing the lower resin chip and covered wires. FIG. 3 is a perspective view of an appearance showing a state after the resin chips are melt-fixed. FIG. 4 is a schematic view showing a cross section taken in a direction of the arrow IV. FIG. 5 is a sectional view taken along the lines V—V.

According to the instant embodiment shown in FIG. 1, two covered wires W1, W2 each of which comprises a conductive wire portion 1 and a cover portion 3 which is formed of resin and coated around the outer periphery of the conductive wire portion, are conductively connected to each other at connection portions (overlapping portion) S thereof as shown in FIG. 1.

For the connection of the two covered wires W1, W2 are used a pair of resin chips 13, 15 serving as a resin material 11, a horn (not shown) for producing ultrasonic vibration and an anvil (not shown) for supporting the covered wires W1, W2 and the resin chips 13, 15 when the connection between the covered wires is performed, like conventional cases. Description thereof in details is omitted.

A pair of resin chips are formed in a substantially circular plate form. One (upper) resin chip has a convex flat portion 21*a* which is a first melting portion in the center portion of a surface (bottom surface) 13*a* of a resin chip 13. Therearound, an outer edge flat portion 22, which is a second melting portion, is disposed separated from the convex flat portion 21*a*. The convex-flat portion 21*a* is a top surface (circular surface) of a cylindrical protrusion 21 disposed so as to protrude from the outer edge flat portion 22. A concave flat portion 31*a*, which is a first melting portion, is disposed in the center of a surface (top surface) 15*a* of the other (lower) resin chip 15. Therearound, an outer edge flat portion 32, which is a second melting portion, is disposed separated from the concave flat portion 31*a*. The concave flat portion 31*a* is a bottom face (circular flat portion 31*a*) of a circular hole 31 disposed so as to indent from the outer edge flat portion 32 and has a slightly larger dimension than the convex flat portion 21*a*. When the resin chips 13, 15 are overlapped with each other in the anvil, the protrusion 21 is inserted into the hole 31 such that the convex flat portion 21*a* and the concave flat portion 31*a* pinch the connection portions S of the covered wires W1, W2. Then, the convex flat portion 21*a* and the concave flat portion 31*a* are melt-fixed so as to include the connection portions S. On the other hand, the upper and lower outer edge flat portions 22, 32 are portions not including the connection portions S for the covered wires W1, W2 in a state in which the resin chips 13, 15 are overlapped with each other in the anvil and melt-fixed at portions excluding the connection portions S.

The upper outer edge flat portion 22 has groove shaped passage routes 23 extending radially in four directions from the protrusion 21. The lower outer edge flat portion 32 has groove shaped passage routes 33 extending radially in four directions from the hole 31 corresponding to the upper passage routes 23. The upper and lower passage routes 23, 33 are formed in a semi-circular shape so that they have a slightly larger internal diameter than the outer diameter of the covered wires W1, W2 and form a circular hole communicating the central portion of the resin chips 13, 15 with outside when the upper and lower resin chips 13, 15 are fitted together. The upper and lower outer edge flat portions 22, 32 are disposed on outer edge portions of surfaces 13*a*, 15*a* of the resin chips 13, 15 excluding the convex flat portion 21*a*, the concave flat portion 31*a* and four passage routes 23, 33. The respective passage routes 23, 33 have wire nipping portions 25, 35 which are disposed so as to protrude substantially in the center in a direction of wire passage. Internal surfaces 27, 37 of the wire nipping portions 25, 35 are formed in a shape of internal diameter smaller than the internal diameter of the passage routes 23, 33 and nip the cover portions 3 of the covered wires W1, W2 after the resin chips 13, 15 are melt-fixed.

As material of the resin chips 13, 15 may be used acrylic resin, ABS (acrylonitrile-butadiene-styrene copolymer) resin, PC (polycarbonate) resin, PVC (polyvinyl chloride) resin, PE (polyethylene) resin, PEI (polyetherimide), PBT-G (polybuthylene terephtalate containing glass) or the like. Generally, harder material than vinyl chloride or the like for use in the covered portion 3 is utilized. As for adaptability of these resin material for the resin chips 13, 15, all these resin materials are recognized to be actually effective in terms of conductivity and conductive stability. If judging from appearance and insulation performance as well, particularly the PEI resin and PBT resin are the most suitable.

When two covered wires W1,W2 are connected with each other, first both the covered wires W1, W2 are overlapped with each other at the connection portions S and the overlapped connection portions S are pinched by a pair of the resin chips 13, 15 such that the respective covered wires W1, W2 are introduced from the passage routes 23, 33. One (lower) resin chip 15 is inserted into the anvil with its surface 15*a* directed upward. One covered wire W1 is inserted thereto so as to fit the two passage routes 33. Further, the other covered wire W2 is inserted thereto so as to fit the remaining two passage routes 33 (see FIG. 2). Finally, the other resin chip 13 is inserted with its surface 13*a* directed downward. Both the covered wires W1, W2 are arranged such that the connection portions S cross each other at the center of the resin chips 13, 15. Consequently, the connection portions S are pinched by the convex flat portion 21*a* and the concave flat portion 31*a* from up and down in the overlapping direction. With this condition, the wire nipping portions 25, 35 nip the cover portions 3 of the covered wires W1,W2 from outside thereof in the diameter direction.

Subsequently, the cover portions 3 at the connection portions S of the covered wires are melted so as to be dispersed by ultrasonic vibration. Furthermore, the conductive wire portions (core) of the covered wires W1, W2 are conductively contacted with each other at the connection portion S by pressing the covered wires from the outside of the resin chips 13, 15. Thereafter, the pair of the resin chips 13, 15 are mutually melted to seal the connection portion S.

Specifically, the horn is inserted into the anvil onto the finally-inserted upper resin chip 13 and the connection portion S is excited and pressed from the outside of the upper and lower resin chips 13, 15 between the horn and the anvil. The press of the connection portion S is performed by pressing the horn toward the anvil, and the press direction is coincident with the overlapping direction of the covered wires W1, W2.

When the resin materials 11 are melt-fixed to each other by the ultrasonic vibration, the excitation is preferably performed in a direction which substantially perpendicularly intersects to the connection surface of the resin materials 11 because it provides the most excellent melt-fixing state. Therefore, the direction of the excitation of the connection portion S is set to a direction which crosses the confronting convex flat portion 21*a* and the concave flat portion 31*a* of the resin chips 13, 15, that is, it is set to be coincident with the overlapping is direction of the covered wires W1, W2. With this arrangement, longitudinal vibration is produced from the horn.

When the connection portion S is pressed and excited in the above state, the cover portions 3 are first melted and the conductive wire portions 1 of the covered wires W1, W2 are exposed at the connection portion S between the resin chips 13 and 15. At this time, the melted cover portions 3 are extruded from the center side of the resin chips 13, 15 toward the outside thereof because the connection portions S are pressed by the convex flat portion 21*a* and the concave flat portion 31*a* from the upper and lower sides, so that the conductive wire portions 1 are more excellently exposed and surely conductively contacted with each other. Like the press direction, the direction of the excitation of the connection portions S is set to be coincident with the overlapping direction of the covered wires W1, W2, so that the action of extruding the melted cover portions 3 to the outside thereof is promoted. Consequently, the core wires composing the conductive wire portion 1 are sufficiently loosened (see FIG. 4) between the convex flat portion 21*a* and the concave flat portion 31*a* so that the respective core wires are conductively contacted with each other.

When the pressing and exciting operation on the connection portions S is further continued after the melting of the cover portions 3, the resin chips 13, 15 are melted and the confronting convex flat portion 21*a* and the concave flat portion 31*a* of the resin chips 13, 15 are melted to each other through the conductive wire portions 1. In addition, the cover portions 3 adjacent to the conductive wire portions 1 conductively contacted with each other are melted to an outer peripheral surface of the protrusion 21 and further the upper and lower outer edge flat portions 22, 32 are directly melted to each other. The connection portions S of the covered wires W1, W2 are sealed by the convex flat portion 21*a* and the concave flat portion 31*a* and then conductively contacted with each other. The conductive wire portions 1 introduced from the connection portions S pass through the passage routes 23, 33 in a state of being covered with the cover portions 3 and are introduced out of the resin chips 13, 15. The cover portions 3 of the covered wires W1, W2 are nipped by the wire nipping portions 25, 35 in the passage routes 23, 33 (see FIGS. 4, 5).

According to the connection method of the instant embodiment, the covered wires W1,W2 are overlapped with each other at the connection portion S and with the connection portion S being pinched by the pair of the resin chips 13, 15, the cover portion 3 is pressed from the outside of the resin chips 13, 15 so as to be dispersed and melted. Then, the covered wires W1, W2 can be conductively contacted with each other at the connection portion S. Thus, it is not necessary to remove the cover portions 3 to make the covered wires W1, W2 conductively contacted with each other, and thus it is possible to make them conductively contacted with each other by a simple operation.

Further, after the covered wires W1, W2 are conductively contacted with each other at the connection portion S, the upper and lower resin chips 13, 15 are melted together to seal the connection portion S. Thus, a high mechanical strength can be obtained at the connection portion S by the melted and hardened resin chips 13, 15.

Therefore, conductivity characteristic between the covered wires W1 and W2 at the connection portions S can be stabilized by such a high mechanical strength and a sufficient insulation performance.

The connection method according to the present embodiment is a relatively simple method in which the overlapped connection portions S are pinched by the resin chips 13, 15 and the connection portions S are pressed and excited between the horn and the anvil from the outside of the resin chips 13, 15. Further, the connection method and structure according to the instant embodiment do not restrict one covered wire W1 and the mating member to be conductively connected therewith (the other covered wire W2 in the instant embodiment) to any particular shape. Thus, this connection method and structure can be applied to various connections such as connection of the covered wires W1, W2 with terminals thus obtaining a wide availability.

Further, the pair of the resin chips 13, 15 are pinched from up and down in a direction of overlapping the covered wires W1, W2 and the connection portions S are pressed and excited between the horn and the anvil from the outside of the resin chips 13, 15. The pressing direction is set to be coincident with the direction of overlapping the covered wires W1, W2. Thus, when the connection portions S are pressed, the melted cover portion 3 is extruded from the connection portions S toward outside, so that the conductive wire portions 1 are more excellently exposed thereby obtaining a secure conductive contacting state. Further, the direction of excitation is set to be coincident with the direction of overlapping the covered wires W1, W2 like the pressing direction. Thus, it is possible to secure an excellent melting condition of the resin chips 13, 15 and the action of extruding the melted cover portion 3 is accelerated.

Further, both the resin chips 13, 15 are provided with the convex flat portion 21*a* and the concave flat portion 31*a* respectively and the outer edge flat portions 22, 32 formed at position other than the connection portions S. Thus, even if the core wires composing the conductive wire portion 1 are sufficiently loosened between the convex flat portion 21*a* and the concave flat portions 31*a* in order to increase conductivity between the covered wires W1 and W2 and suppress resistance therebetween, the outer edge flat portions 22, 32 are directly melt-fixed to each other not via the conductive wire portion 1. That is, area for directly melt-fixing the resin chips 13, 15 to each other (hatched portion in FIG. 4) can be secured by the outer edge flat portions 22, 32 so that a sufficient melt-fixing force can be secured. Thus, it is possible to achieve reduction of resistance and improvement of mechanical strength.

During actual use after the resin chips 13, 15 are melt-fixed, the wire nipping portions 25, 35 nip the cover portions 3 of the covered wires W1, W2. Thus, if an external force is applied to the covered wires W1, W2, the covered wires W1, W2 are hooked by the wire nipping portions 25, 35, so that external force is not applied to the connection portions S but the wire nipping portions 25, 35 receive this force. Thus, a high wire holding force can be obtained and mechanical strength is further improved.

What is claimed is:

1. A covered wire connection structure for conductively connecting members, at least one of the members being a covered wire having a conductive core portion of core wires and a cover portion formed by coating resin around an outer periphery of the conductive core portion, said structure being formed by overlapping said members with each other and pinching an overlapping portion of said members between a pair of resin chips, pressurizing and exciting said overlapping portion pinched by said resin chips-using an ultrasonic vibration welding apparatus so as to melt and disperse said cover portion, thereby to expose the conductive core portion and electrically connect the conductive core portion of said at least one member with another of the members at said overlapping portion and so as to melt-fix said pair of resin chips to seal the electrically connected overlapping portion of said members with said melt-fixed resin chips, wherein:

each of said resin chips has a first melting portion and a second melting portion;

said first melting portion is located in an area including said overlapping portion and melt-fixed to a mating chip to seal said overlapping portion;

said second melting portion is separated from said first melting portion and melt-fixed to the mating chip in an area other than said overlapping portion, and a passage route so as to pass said covered wire to said overlapping portion; and the core wires of the conductive core portion are in a pressed and loosened state between the first melting portions when the resin chips are melt-fixed to each other.

2. A covered wire connection structure according to claim 1 wherein said first melting portion is provided on a center portion of a surface of said resin chip; and said second melting portion is provided on an outer edge portion excluding said center portion of the surface of said resin chip and passage routes so as to pass said members to said overlapping portion.

3. A covered wire connection structure for conductively connecting members, at least one of the members being a covered wire having a conductive wire portion and a cover portion formed by coating resin around an outer periphery of the conductive wire portion, said structure being formed by overlapping said members with each other and pinching an overlapping portion of said members between a pair of resin chips, pressurizing and exciting said overlapping portion pinched by said resin chips using an ultrasonic vibration welding apparatus so as to melt and disperse said cover portion, thereby to expose the conductive wire portion and electrically connect the conductive wire portion of said at least one member with another member at said overlapping portion and so as to melt-fix said pair of resin chips to seal the electrically connected overlapping portion of said members with said melt-fixed resin chips, wherein:

each of said resin chips has a center portion, an outer edge flat portion, a first melting portion and a second melting portion;

said first melting portion is provided on the center portion of a surface of one of said resin chips and melt-fixed to a mating chip to seal said overlapping portion; and said second melting portion is provided on the outer edge flat portion excluding said center portion of the surface of said one resin chip and a passage route so as to pass said covered wire to said overlapping portion and melt-fixed to the mating chip in an area other than said overlapping portion; and wherein one of said first melting portions is a-convex flat portion which is a top surface of a protrusion disposed so as to protrude from the outer edge flat portion of said one resin chip, and the other of said first melting portions is a concave flat portion which is a bottom surface of a hole disposed so as to indent from the outer edge flat portion of said mating resin chip.

4. A covered wire connection structure according to claim 3 wherein both said members are covered wires and said passage routes for the covered wires contain wire nipping portions for nipping the cover portions of said covered wires as said resin chips are melt-fixed to each other.

5. The covered wire connection structure of claim 3 wherein said passage route for the covered wire contains a wire nipping portion for nipping the cover portion of said covered wire as said resin chips are melt-fixed to each other.

6. A covered wire connection structure for conductively connecting members, at least one of the members being a covered wire having a conductive wire portion and a cover portion formed by coating resin around an outer periphery of the conductive wire portion, said structure being formed by overlapping said members with each other and pinching an overlapping portion of said members between a pair of resin chips, pressurizing and exciting said overlapping portion pinched by said resin chips using an ultrasonic vibration welding apparatus so as to melt and disperse said cover portion, thereby to expose the conductive wire portion and electrically connect the conductive wire portion of said at least one member with another of the members at said overlapping portion and so as to melt-fix said pair of resin chips to seal the electrically connected overlapping portion of said wires with said melt-fixed resin chips, wherein:

each of said resin chips has a first melting portion and a second melting portion;

said first melting portion is provided on a center portion of a surface of one of said resin chips and melt-fixed to a mating chip to seal said overlapping portion;

said second melting portion is an outer edge flat portion excluding said center portion of the surface of said one resin chip and a passage route so as to pass said covered wire to said overlapping portion and melt-fixed to the mating chip in an area other than said overlapping portion; and wherein said passage route for the covered wire contains a wire nipping portion for nipping the cover portion of said covered wire as said resin chips are melt-fixed to each other.

* * * * *